United States Patent [19]

Bryant

[11] Patent Number: 5,040,264

[45] Date of Patent: Aug. 20, 1991

[54] DEODORIZING VACUUM BAG WITH STATIC PROTECTION

[76] Inventor: Roy D. Bryant, 2240 Hume Rd., Lexington, Ky. 40516

[21] Appl. No.: 518,967

[22] Filed: May 4, 1990

[51] Int. Cl.[5] ..... A47L 9/14

[52] U.S. Cl. ..... 15/339; 15/257 B; 55/279; 55/381; 55/524; 361/212

[58] Field of Search ..... 15/257 B, 339; 55/279, 55/381, 382, 524; 361/212

[56] References Cited

U.S. PATENT DOCUMENTS

| | | | |
|---|---|---|---|
| 1,782,640 | 11/1930 | Wenner-Gren . | |
| 1,881,086 | 10/1932 | Marshall | 55/279 |
| 1,938,378 | 11/1933 | Ell . | |
| 2,211,468 | 8/1940 | Marsh | 55/279 X |
| 2,272,394 | 2/1942 | Armstrong . | |
| 3,274,758 | 9/1966 | Parman | 55/279 |
| 4,554,698 | 11/1985 | Rennecker et al. | 15/339 |
| 4,697,300 | 10/1987 | Warlop | 15/339 X |
| 4,715,085 | 12/1987 | Johanson | 361/212 X |
| 4,715,086 | 12/1987 | Johanson et al. | 361/212 X |
| 4,866,565 | 9/1989 | Wray | 15/339 X |

*Primary Examiner*—Chris K. Moore

*Attorney, Agent, or Firm*—King and Schickli

[57] ABSTRACT

A vacuum cleaner bag of porous material includes a substrate impregnated with anti-static and deodorizing agents. The substrate may also be impregnated with disinfecting agents. Preferably, the substrate is attached to the bag.

6 Claims, 1 Drawing Sheet

DEODORIZING VACUUM BAG WITH STATIC PROTECTION

TECHNICAL FIELD

The present invention relates generally to dust collectors of the porous type including a porous bag in which dust particles are trapped as dust laden air is forced into the bag. More particularly, this invention relates to a vacuum cleaner bag including a porous substrate impregnated with anti-static and deodorizing agents that are gradually released during vacuum cleaner operation.

BACKGROUND OF THE INVENTION

Vacuum cleaners that force air through a porous bag which forms a dust and dirt collecting enclosure have long been known in the art. While such devices are particularly adapted for and effective in collecting even fine particles of dust and dirt, a vacuum cleaner equipped with a bag alone does little to freshen and deodorize the air that passes from the bag. In fact, the exhausted air may even pick up undesirable odors from dirt already in the bag. These odors are then transferred to the room being vacuumed.

This unfortunate problem has been recognized in the art and various attempts have been made to fully address and solve the problem. For example, U.S. Pat. No. 4,554,698 to Renaker et al. discloses a vacuum cleaner equipped with a scent dispensing arrangement. More particularly, a portion of the air exhausted from the vacuum bag is directed through a scent dispenser including a fragrance tablet. The fragrance tablet readily volatilizes to mix with the air which is then exhausted into the room.

While this system does serve to provide some air freshening, it does suffer from several drawbacks. More specifically, the operator must remember to periodically add a new fragrance tablet to the scent dispenser, otherwise, the system is effectively rendered inoperative. Additionally, it should be appreciated that only some of the exhausted air is routed through the scent dispenser. The other portion remains untreated and is exhausted into the room. Hence, this system still serves to spread some odors from the vacuum bag into the room in this untreated air.

It should also be appreciated that vacuum cleaners of the upright type typically include rotating agitators that have brushes that scrub the carpet being cleaned. Under certain conditions, such as the cleaning of a wool carpet in dry winter air, electro-static charges are produced by the scrubbing action of the brushes of the rotating agitator against the carpet. These electro-static charges tend to build up in the vacuum cleaner and may actually be transferred to the operator manipulating the vacuum cleaner through a control handle. As a result, the operator may receive a sharp shock as, for example, when reaching for a door knob. While not a particularly dangerous problem, many find the resulting shock uncomfortable and even disconcerting. Accordingly, it would be preferred if the build-up of electro-static charges directly leading to the shock could be avoided.

SUMMARY OF THE INVENTION

Accordingly, it is a primary object of the present invention to provide an improved vacuum cleaner bag overcoming the above-described limitations and disadvantages of the prior art.

Another object of the present invention is to provide an improved vacuum cleaner bag of simple, inexpensive construction providing both effective anti-static and deodorizing activity.

Yet another object of the invention is to provide a vacuum cleaner bag that purifies and disinfects substantially all the air passing through the bag so as to substantially eliminate the spreading of odors from the dirt trapped in the bag into the room being vacuumed.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved dust and dirt collecting apparatus for a vacuum cleaner is provided. The apparatus includes a porous bag of paper or other appropriate material known in the art defining a dust and dirt collecting enclosure in which dust laden air is directed. Anti-static and deodorant releasing means are also provided in the bag. More particularly, a porous substrate is impregnated with volatilizable anti-static and deodorizing agents. Sufficient amounts of these agents are impregnated into the substrate so that the anti-static and deodorizing activity is provided substantially continuously over the full service life of the bag. Once the bag is full of dust and dirt, it is replaced by a new bag including the same impregnated substrate providing anti-static and deodorizing activity over its entire service life. Accordingly, it should be appreciated that the necessary anti-static and deodorizing agents are conveniently and automatically renewed with each change of the vacuum cleaner bag.

Preferably, the impregnated substrate is adhered to the wall of the vacuum cleaner bag. This substrate may also be impregnated with a disinfecting agent. Accordingly, as the air is exhausted through the bag, it is treated to substantially eliminate odor and germs before release into the room being vacuumed. Accordingly, the room and particularly the carpet are cleaner and fresher. Additionally, the anti-static agents of the substrate serve to suppress static build-up thereby reducing and in some cases eliminating the static shock problem characteristic of vacuum cleaners equipped with a traditional vacuum cleaner bag.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

Reference will now be made in detail to the present preferred embodiment of the invention, an example of which is illustrated in the accompanying drawing.

DETAILED DESCRIPTION OF THE INVENTION

Figure 1:
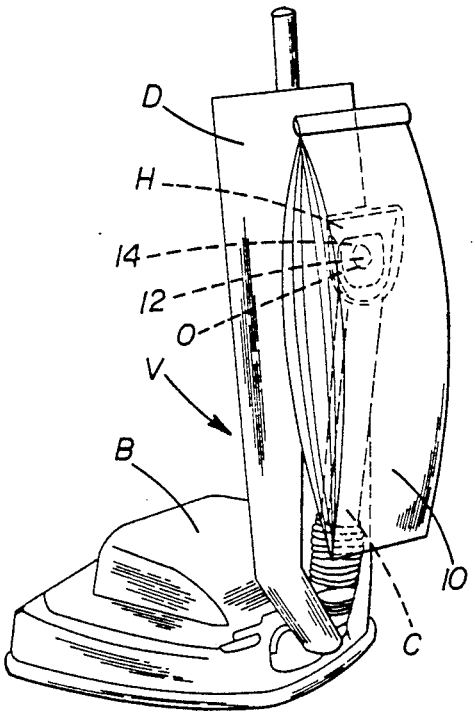
FIG. 1 is a perspective view of an upright vacuum cleaner equipped with the vacuum cleaner bag of the present invention.

Reference is now made to FIG. 1 showing a vacuum cleaner V equipped with a vacuum cleaner bag 10 of the present invention. As is known in the art, the upright vacuum cleaner V includes a conventional main or floor engaging body B that houses a nozzle, rotary agitator and motor-fan unit (not shown). The motor-fan unit creates a flow of dirt laden air through the main body B and transfer conduit C. The dirt laden air is then directed through an outlet port O at the end of the transfer conduit C through a cooperating inlet port 12 into the vacuum cleaner bag 10 of the present invention.

As is known in the art, the bag 10 includes a cardboard mounting flange 14 that is received within a holder H on the end of the transfer conduit C so as to retain the inlet 12 of the vacuum cleaner bag 10 in direct alignment with the outlet O of the transfer conduit C. Once the flange 14 is properly positioned within the holder H, the transfer conduit C and bag 10 are manipulated into the outer bag D of the vacuum cleaner V which is then closed as, for example, by a zipper (not shown).

The dust and dirt collecting apparatus of the bag 10 of the present invention is formed from a porous material 16 that defines a dust and dirt collecting enclosure. Bags 10 of close mesh fabric, paper and other porous material to allow the passage of the air but the trapping of fine particles of dirt and dust are well known in the art.

Figure 2:
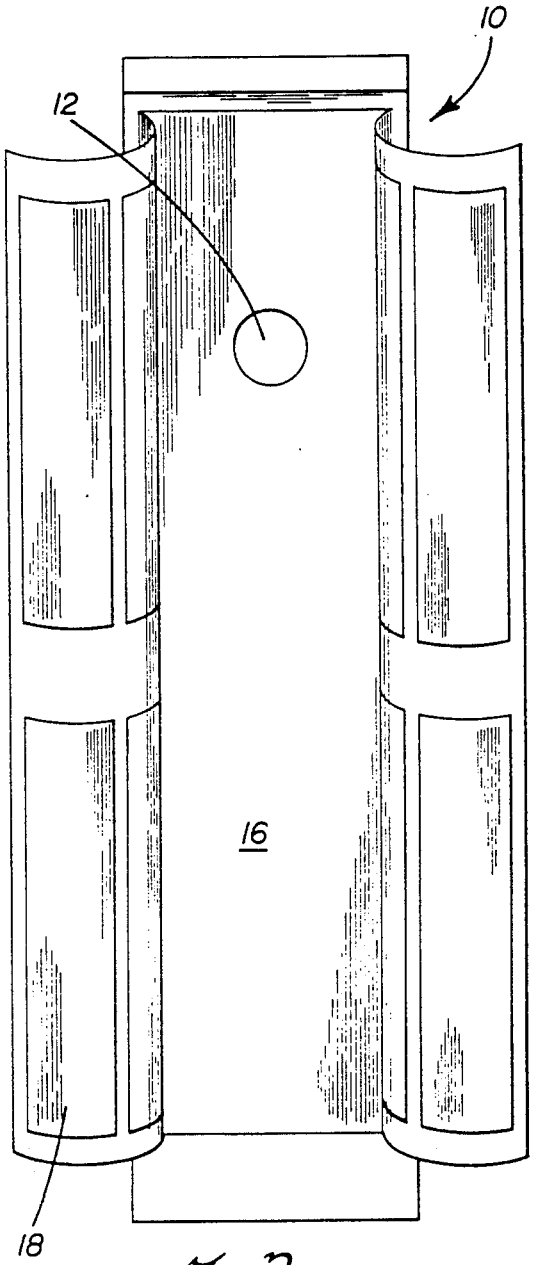
FIG. 2 is a side elevational view of the vacuum cleaner bag of the present invention cut and pulled open to show substrate strips impregnated with anti-static and deodorizing agents attached to the walls of the vacuum cleaner bag of the present invention.

The bag 10 of the present invention also includes anti-static and deodorant releasing means that is actuated by the passing air and heat from the motor-fan unit. The anti-static and deodorant releasing means is shown in FIG. 2 as a porous substrate 18 that is impregnated with volatile anti-static and deodorizing agents. Appropriate anti-static agents include, for example, 2-hydroxypropyl monoester quarternized ammonium salts and tertiary amine-multi-functional carboxylic acid complexes. These may be in combination with volatilizing agents where appropriate. Appropriate deodorizing agents and scents include pine oil, spearmint oil and sodium bicarbonate as well as other perfumes and fragrances. It should be recognized, however, that other, known anti-static agents, deodorizing agents and scents may be utilized.

Preferably, the porous substrate material comprises adhesive backed paper although other substrate materials known in the art and appropriate for the purpose may be utilized. The strips 18 are adhered through the adhesive backing to the inner wall of the vacuum cleaner bag 10 so as to cover a large portion or substantially all of the surface of the bag. In this way, the air being forced through the bag is more likely to contact the impregnated substrate and be treated with the anti-static and deodorizing agents. Advantageously, these agents serve to deodorize the air being exhausted and prevent odors from passing from the vacuum cleaner bag into the room. Further, the entrapped anti-static and deodorizing agents settle from the exhausted air and are introduced into the carpet. Accordingly, the room has a fresher cleaner smell after vacuuming. Additionally, the anti-static agents suppress static build-up and substantially reduce the potential for static shock to the vacuum cleaner operator.

In accordance with a further aspect of the present invention, the substrates 18 may also be impregnated with a disinfectant or germicidal agent. Examples of such agents include poly bromosalicylanilide, tribromosalicylanilide, hexachlorophene, neomycin sulfate, alkyl dimethyl ethylbenzyl ammonium chloride, and O-phenylphenol. It should be recognized, however, that other known germicidal agents may be utilized.

While the preferred embodiment shown relates to the incorporating of porous substrate sheets 18 impregnated with the appropriate agents adhered to the wall of the bag 10, it should be appreciated that such impregnated sheets of substrate may, also, simply be retained loosely in the bag 10. Further, the anti-static, deodorizing and/or disinfecting/germicidal agents may simply be applied to the surface of the bag in a spray or added to a vacuum cleaner bag in the form of powders or as a tablet. It should be appreciated, however, that the preferred embodiment ensures a greater coverage of the surface area of the bag with a greater amount of treating agents and hence the passage of more air through the substrate to allow more effective deodorizing, static suppressing and disinfecting/germicidal activity.

In summary, numerous benefits result from employing the concepts of the present invention. The vacuum cleaner bag 10 of the present invention provides improved deodorizing activity treating substantially all the air passing from the dirt and dust collecting enclosure formed by the bag 10. Hence, not only dirt and dust but also odors are essentially trapped within the bag rather than passed through the air and back into the room. The vacuum cleaner bag 10 of the present invention also provides suppression of static electricity build-up and hence significantly reduces the possibility of the operator experiencing static shock as a direct result of the operation of the vacuum cleaner. Further, the incorporation of disinfecting/germicidal agents in the bag 10 serves to prevent the spread of germs which infest the dust and dirt being removed from the carpet and are particularly adapted to grow in the vacuum cleaner bag during its service life.

The foregoing description of a preferred embodiment of the invention has been presented for purposes of illustration or description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A dust and dirt collecting apparatus for a vacuum cleaner, comprising:

a porous bag defining a dust and dirt collecting enclosure; and anti-static and deodorant releasing means in or on said bag for suppressing static build-up and deodorizing air passing through said vacuum cleaner.

2. The apparatus set forth in claim 1, wherein said anti-static and deodorant releasing means includes a porous substrate impregnated with anti-static and deodorizing agents.

3. The apparatus set forth in claim 2, wherein said substrate is adhered to said bag.

4. The apparatus set forth in claim 2, wherein said porous substrate is further impregnated with a disinfecting agent.

5. The apparatus set forth in claim 1, wherein said anti-static and deodorant releasing means includes a porous substrate strip impregnated with anti-static and deodorizing agents freely received within said bag.

6. A dust and dirt collecting apparatus for a vacuum cleaner, comprising:

a porous bag defining a dust and dirt collecting enclosure; and anti-static releasing means in said bag for suppressing static build-up.

* * * * *